US005295362A

United States Patent [19]

Shaw et al.

[11] Patent Number: 5,295,362

[45] Date of Patent: Mar. 22, 1994

[54] ELECTRONIC SLIDE VALVE BLOCK

[75] Inventors: David N. Shaw, Glastonbury, Conn.; Edward A. Huenniger, Liverpool, N.Y.

[73] Assignee: Carrier Corporation, Syracuse, N.Y.

[21] Appl. No.: 43,415

[22] Filed: Apr. 6, 1993

[51] Int. Cl.[5] ..... F25B 43/02

[52] U.S. Cl. ..... 62/193; 62/209; 62/201; 62/228.5; 62/226

[58] Field of Search ..... 62/208, 209, 192, 193, 62/201, 215, 216, 217, 226, 227, 228.1, 228.3, 228.4, 228.5, 468, 469

[56] References Cited

U.S. PATENT DOCUMENTS 4,180,986 1/1980 Shaw ..... 62/192

4,257,795 3/1981 Shaw ..... 62/209 X 4,538,421 9/1985 Kawamoto ..... 62/201 X 5,086,621 2/1992 Starner et al. ..... 62/193 X

*Primary Examiner*—Harry B. Tanner

[57] ABSTRACT

Loss of oil due to oil feedback is prevented in a screw compressor in a refrigeration application due to low capacity operation. The apparent suction temperature is compared to the temperature of the water exiting the evaporator to determine the apparent superheat and the loading is increased upon the apparent superheat reaching a predetermined level. Upon sensing a predetermined difference, an electronic slide valve block is initiated to prevent further unloading and loading may be initiated in a fixed amount, incrementally or on a pulsed basis.

8 Claims, 1 Drawing Sheet

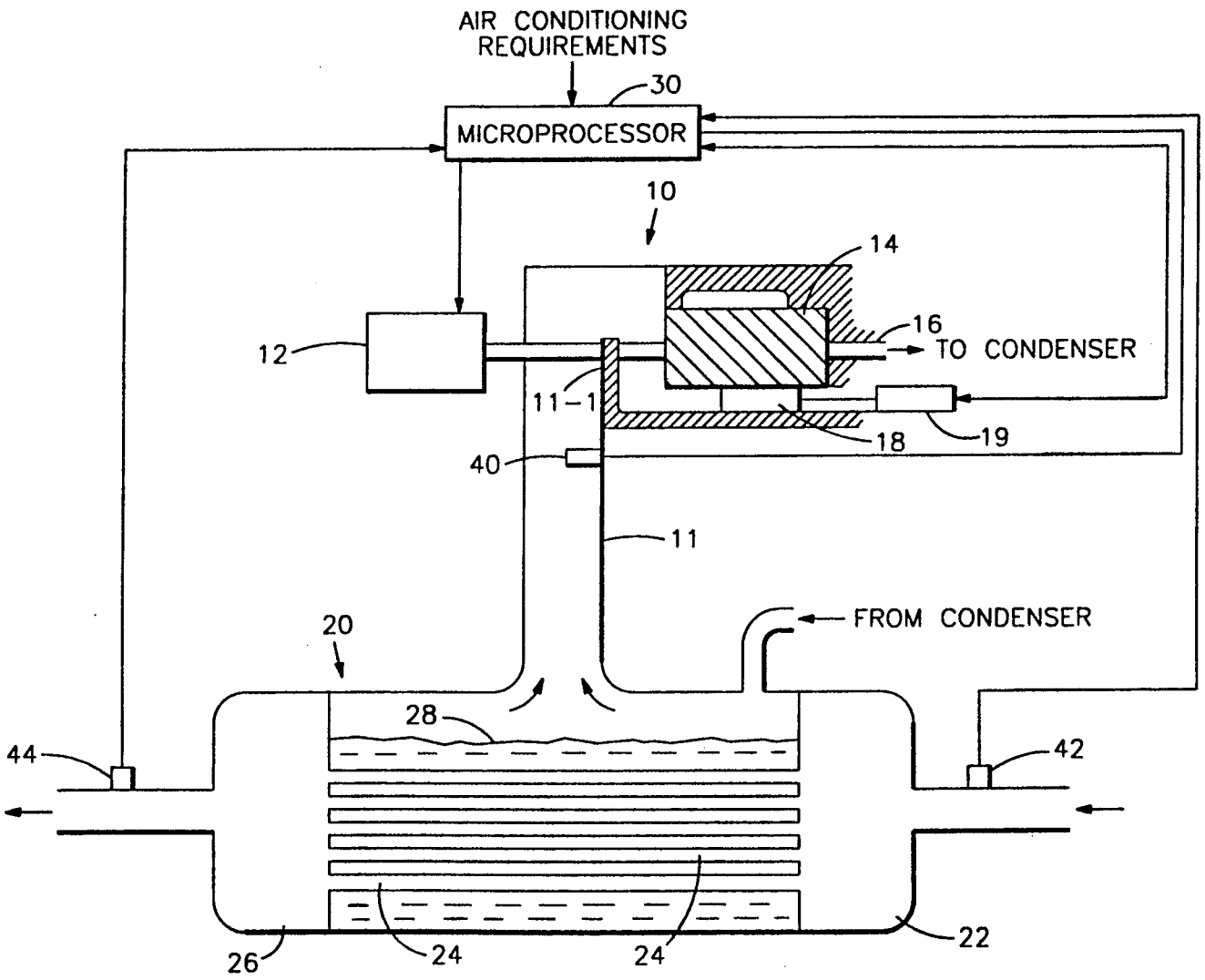
AIR CONDITIONING REQUIREMENTS
30
MICROPROCESSOR
10
14
16
TO CONDENSER
19
18
11-1
12
40
11
FROM CONDENSER
42
22
24
28
24
20
26
44

ELECTRONIC SLIDE VALVE BLOCK

BACKGROUND OF THE INVENTION

Screw compressors in refrigeration and air conditioning applications commonly have slide valves which are adjusted to control capacity. When the capacity is too low, oil is "lost" to the evaporator with the potential for damage to the compressor due to inadequate lubrication. At light load the sensing of the slide valve position is not good enough for proper control since the actual capacity is a function of the discharge pressure. Specifically, there is a high leakback of refrigerant and oil at high discharge pressure so the capacity is less at high head then at low head for the same slide valve position.

SUMMARY OF THE INVENTION

In a refrigeration system including a slide valve and a flooded evaporator, warm oil can flow back to suction and then to the evaporator under low capacity conditions. Since loss of oil is the condition to be avoided and since the oil is warm, the condition of oil feedback can be sensed as an increase in the temperature sensed by a sensor in the suction line resulting from the warm oil impacting the sensor and giving rise to an apparent increase in the sensed suction gas temperature. If such a condition, indicative of oil feedback, is sensed, the capacity is increased until the condition is corrected. With a falling capacity condition, the resultant sensed temperature rise will first stop further capacity loss by blocking the electronic slide valve. Then, if desired or required, capacity is increased by moving the slide valve. If necessary or desired, there may be a pulsed loading.

It is an object of this invention to be able to operate at low capacity without turning off the compressor.

It is another object of this invention, under all operating conditions, to allow the compressor to go to minimum capacity consistent with minimum loss of oil to the evaporator. These objects, and others as will become apparent hereinafter, are accomplished by the present invention.

Basically, when apparent suction superheat rises during a highly unloaded operation, further unloading (capacity loss) is prevented. If the apparent superheat rises further, loading (capacity) is increased until the superheat is within a valid range which will not allow oil accumulation in the evaporator.

BRIEF DESCRIPTION OF THE DRAWINGS

For a fuller understanding of the present invention, reference should now be made to the following detailed description thereof taken in conjunction with the accompanying drawings wherein:

The FIGURE is a simplified sectional view of a screw compressor employing the present invention and located in a refrigeration system.

DESCRIPTION OF THE PREFERRED EMBODIMENT

In the FIGURE, the numeral 10 generally designates a screw compressor which is fluidly connected to evaporator 20 and is controlled by microprocessor 30. Evaporator 20 is of the flooded type in which hot water is supplied to header 22 which feeds tubes 24 which are beneath the level of the refrigerant 28. The hot water causes boiling of the refrigerant which cools the water. The cooled water flows from tubes 24 into header 26 from which the cooled water is supplied to a heat source and heated before being returned to header 22 as hot water. The gaseous refrigerant boiled off in evaporator 20 is drawn into suction line 11 responsive to the operation of compressor 10. Specifically, motor 12 drives the rotors 14, only one of which is illustrated, as is conventional, and gas is drawn in, trapped, compressed and discharged via discharge line 16. Electronic slide valve 18 is positioned by hydraulic actuator 19 which may be of the type employing solenoid valves and disclosed in commonly assigned U.S. Pat. No. 5,004,894. Motor 12 and hydraulic actuator 19 are operated under the control of microprocessor 30 which also receives inputs indicating refrigeration or air conditioning requirements. The system described so far is generally conventional and, if compressor 10 is sufficiently unloaded, high leakback will force warm oil over dam 11-1 into a counter flow relationship with the suction flow and into evaporator 20 where the oil tends to collect. If uncorrected, the compressor 10 will be taken off line due to oil loss. The problem is that where a compressor is taken off line, it is hard to get it back on line. Oil must be initially added to permit running and then the added oil must be removed while the system is in operation.

The present invention adds sensor 40 which senses the temperature in suction line 11 and provides that information to microprocessor 30. Sensors 42 and 44 respectively sense the temperature of the water entering and leaving evaporator 20 and supply that information to microprocessor 30. The difference in temperature between entering water sensed by sensor 42 and the leaving water sensed by sensor 44 is a measure of the heat given up to refrigerant 28. The temperature of the leaving water sensed by sensor 44 which, subject to the specific configuration of evaporator 20 and the conditions imposed upon it, represents the warmest possible temperature of refrigerant when compared to the temperature of the suction gas sensed by sensor 40 reflects heating of the suction gas beyond that due to the thermal gradient resulting from the heat loss by the water to the refrigerant in evaporator 20. Specifically, if warm oil is passing into evaporator 20 via the suction line 11, there will be a heating of the sensor 40 in suction line 11 to the compressor 10 due to the warm oil impacting sensor 40 thereby increasing the apparent sensed superheat. Locally, the water temperature in tubes 24 just below the suction line 11 could be warmer than the leaving chilled water temperature sensed by sensor 44, and result in a sensed apparent superheat of the suction gas. This could be cured by adjusting the sensed temperature difference required to trigger the electronic slide valve block in accordance with the specific evaporator design.

In operation, the temperature of the gaseous refrigerant in suction line 11 is sensed by sensor 40 and communicated to microprocessor 30. Microprocessor 30 compares the temperature sensed by sensor 40 with the temperature sensed by sensor 44 which represents the leaving temperature of the water and the boiling temperature of the liquid refrigerant in evaporator 20. A difference of 3° to 4° F. would be acceptable but, if the difference starts to increase significantly, warm oil is being blown back which will result in too much oil in the evaporator and not enough in the sump. Upon the sensing of a sufficient difference in temperatures, microprocessor 30 initially causes the blocking of the electronic slide valve 18 and, if necessary or desired, subsequently causes the loading of compressor 10 by repositioning slide valve 18 via hydraulic actuator 19 until the difference in temperature is within a valid range which will not allow oil accumulation in the evaporator 20. The loading may be automatic upon the sensing of the predetermined temperature difference or may require an increased temperature difference after the blocking of electronic slide valve 18. The loading of compressor 10 under these circumstances is an overriding of the air conditioning or refrigeration requirements.

Although a preferred embodiment of the present invention has been illustrated and described, other changes will occur to those skilled in the art. For example, other means can be used to sense oil loss such as an optical sensor, an oil level sensor in the evaporator or oil sump, or a refrigerant level sensor in the evaporator. Also, the saturated temperature of the refrigerant in evaporator 20 may be sensed rather than the temperature of the chilled water leaving evaporator 20. It is therefore intended that the scope of the present invention is to be limited only by the scope of the appended claims.

What is claimed is:

1. A refrigeration system including:

evaporator means containing liquid refrigerant and including means for supplying liquid refrigerant to said evaporator means;

screw compressor means including a suction line connected to said evaporator means for supplying gaseous refrigerant to said screw compressor means;

electronic slide valve means for controlling capacity of said screw compressor means;

means for supplying heated fluid to said evaporator means to cause boiling of said liquid refrigerant and thereby cooling said heated fluid;

means for withdrawing said cooled fluid from said evaporator means;

means for providing a signal representative of a condition representing oil feeding back from said compressor means to said evaporator means;

means for providing a signal representative of the temperature of said gaseous refrigerant;

means for comparing said signals representative of the feeding back of oil and the temperature of said gaseous refrigerant and for blocking further unloading of said screw compressor means by said electronic slide valve means when said compared signals exceed of a predetermined value.

2. The refrigeration system of claim 1 wherein said screw compressor means is loaded when said compared signals exceed said predetermined value.

3. The refrigeration system of claim 1 wherein said screw compressor means is loaded when said compared signals exceed a second, larger predetermined value.

4. The refrigeration system of claim 1 wherein said means for providing a signal representative of the temperature of said gaseous refrigerant senses the temperature of said cooled fluid.

5. The refrigeration system of claim 1 wherein said means for providing a signal representative of a condition representing oil feedback is located in said suction line and is subject to contact by warm oil feeding back from said compressor means under low capacity conditions resulting in the sensing of an apparently higher temperature in said suction line.

6. A refrigeration system including:

evaporator means containing liquid refrigerant and including means for supplying liquid refrigerant to said evaporator means;

screw compressor means including a suction line connected to said evaporator means for supplying gaseous refrigerant to said screw compressor means;

means for supplying heated fluid to said evaporator means to cause boiling of said liquid refrigerant and thereby cooling said heated fluid;

means for withdrawing said cooled fluid from said evaporator means;

means for providing a signal representative of the apparent temperature in said suction line;

means for providing a signal representative of the temperature of said cooled fluid;

means for comparing said signals representative of the temperatures in said suction line and said cooled fluid and for loading said screw compressor means when the apparent temperature in said suction line exceeds the temperature of the cooled fluid by a predetermined amount.

7. The refrigeration system of claim 6 wherein said screw compressor means is loaded by positioning a slide valve.

8. The refrigeration system of claim 6 wherein said means for providing a signal representative of the temperature in said suction line is subject to contact by warm oil feeding back from said compressor means under low capacity conditions resulting in the sensing of an apparently higher temperature in said suction line.

* * * * *